US010327994B2

(12) United States Patent
Patel

(10) Patent No.: US 10,327,994 B2
(45) Date of Patent: Jun. 25, 2019

(54) SYSTEM AND METHODS FOR CUSTOMIZED MEDICINE DOSAGES IN A CAPSULE

(71) Applicant: Miteshkumar Ishwarbhai Patel, San Leandro, CA (US)

(72) Inventor: Miteshkumar Ishwarbhai Patel, San Leandro, CA (US)

(73) Assignee: DOSE PACK LLC, San Juan, PR (US)

( * ) Notice: Subject to any disclaimer, the term of this patent is extended or adjusted under 35 U.S.C. 154(b) by 499 days.

(21) Appl. No.: 15/144,437

(22) Filed: May 2, 2016

(65) Prior Publication Data

US 2017/0312178 A1 Nov. 2, 2017

(51) Int. Cl.

| | |
|---|---|
| ***A61J 3/07*** | (2006.01) |
| ***A61J 3/08*** | (2006.01) |
| ***A61J 7/00*** | (2006.01) |
| ***A61J 7/02*** | (2006.01) |
| ***B65B 39/00*** | (2006.01) |
| ***B65B 43/42*** | (2006.01) |
| ***B65B 61/20*** | (2006.01) |
| ***B65B 7/16*** | (2006.01) |

(52) U.S. Cl.

CPC ..... *A61J 3/07* (2013.01); *A61J 3/074* (2013.01); *A61J 3/08* (2013.01); *A61J 7/0084* (2013.01); *A61J 7/02* (2013.01); *B65B 7/16* (2013.01); *B65B 39/007* (2013.01); *B65B 43/42* (2013.01); *B65B 61/207* (2013.01); *A61J 2205/60* (2013.01)

(58) Field of Classification Search

CPC ..... A61J 3/07; A61J 3/074; A61J 3/08; A61J 7/0084; A61J 7/02; A61J 2205/60; B65B 7/16; B65B 39/007; B65B 43/42; B65B 1/04; B65B 1/30; B65B 11/52; B65B 61/207; A61K 45/00; A61K 31/00; A61K 33/00; A61K 2300/00; A61K 2800/00

USPC ..... 53/471, 410, 900, 396, 445, 474; 222/80

See application file for complete search history.

(56) References Cited

U.S. PATENT DOCUMENTS

| | | | | | |
|---|---|---|---|---|---|
| 2,823,502 | A * | 2/1958 | Rambold | B65B 29/02 | 206/0.5 |
| 3,410,452 | A * | 11/1968 | Wolfgang | B65G 15/42 | 221/13 |
| 3,446,397 | A * | 5/1969 | Chambers | B65B 5/103 | 221/296 |
| 3,568,735 | A * | 3/1971 | Lancaster | B01L 3/0217 | 141/238 |
| 3,775,941 | A * | 12/1973 | Bross | B65B 5/103 | 221/296 |
| 3,841,363 | A * | 10/1974 | Stigler | B65B 3/323 | 141/142 |

(Continued)

*Primary Examiner* — Alexander M Valvis
*Assistant Examiner* — Lucas E. A. Palmer
(74) *Attorney, Agent, or Firm* — Firasat Ali; Creso Legal LLP

(57) ABSTRACT

A medicine dispensing system includes canisters and packing assemblies to place specific doses of medicines into capsules. The system removes inert and filler ingredients to place only those active ingredients prescribed to the patient. The system includes a conveyor belt to move the capsules between canisters filled with the active ingredients. A dose is placed and packed into the capsules for each active ingredient. Thus, the number of capsules for a variety of medicines is reduced.

9 Claims, 16 Drawing Sheets

(56) References Cited

U.S. PATENT DOCUMENTS 4,731,979 A * 3/1988 Yamamoto ..... A61J 3/074 53/281
5,230,207 A * 7/1993 Hartzell ..... A61J 3/07 53/547
5,240,049 A * 8/1993 Chiari ..... B65B 1/385 141/144
5,617,710 A * 4/1997 Goossens ..... A61J 3/072 53/281
6,971,546 B2 * 12/2005 Costa ..... A47J 31/3633 221/297
7,694,497 B2 * 4/2010 Tagliavini ..... A61J 3/074 53/452
7,779,614 B1 * 8/2010 McGonagle ..... A61J 1/035 53/238
2002/0195459 A1 * 12/2002 Greenwald ..... A61J 7/0084 221/289
2007/0193225 A1 * 8/2007 Bailey ..... A61J 3/06 53/281
2008/0190076 A1 * 8/2008 Klingel ..... B65B 5/103 53/493
2008/0223001 A1 * 9/2008 Monti ..... B65B 5/105 53/246
2009/0139187 A1 * 6/2009 Wood ..... B65B 9/02 53/424
2011/0061345 A1 * 3/2011 Cherukuri ..... A61J 3/00 53/473
2011/0126495 A1 * 6/2011 Tampieri ..... B65B 5/06 53/447
2012/0192528 A1 * 8/2012 Ansaloni ..... A61J 3/074 53/467
2013/0280323 A1 * 10/2013 Fang ..... A61K 9/4808 424/451
2015/0166204 A1 * 6/2015 Rea ..... B65B 29/02 53/452
2016/0089302 A1 * 3/2016 Scheffler ..... B65B 1/04 53/284.5
2018/0065765 A1 * 3/2018 Koike ..... A61J 3/00
2018/0104908 A1 * 4/2018 Berger ..... B29C 66/81262
2018/0186483 A1 * 7/2018 Fujii ..... B65B 1/30
2018/0186484 A1 * 7/2018 Kikuchi ..... B65B 57/02
2018/0360690 A1 * 12/2018 Garfield ..... A61J 1/2048
2019/0016484 A1 * 1/2019 Diaz Guerrero ..... B65B 43/60
2019/0029922 A1 * 1/2019 Tagliavini ..... A61J 3/074

* cited by examiner

SYSTEM AND METHODS FOR CUSTOMIZED MEDICINE DOSAGES IN A CAPSULE

FIELD OF THE INVENTION

The present invention relates to dispensing daily dosages of medications. More particularly, the present invention relates to the customization and modification of daily dosages of medication for administration to patients by reducing the number of pills and customizing the medications to be placed in a capsule.

DISCUSSION OF THE RELATED ART

Medication management systems play an integral part of long-term care facilities. For example, companies recognized the need for pharmacies to provide customers a secure, affordable and fully customized solution for medication management. Most patients rely upon the conventional process of a doctor and a pharmacist to make decisions about their dosing of medications.

Pills, tablets and the like (hereinafter tablet) come in many different colors, shapes, and sizes. Often, one tablet is used to provide one ingredient or medicine. Sometimes, a tablet may include two ingredients, such as a pain reliever and an allergy suppressant. Tablets, however, are filled with many inert ingredients, such as diluents and fillers, binders, disintegrants, lubricants, glidants, absorbants, flavorants and colorants.

As the population ages, many older citizens can take up to 20-30 pills per day for a multitude of chronic or acute diseases. Oral medicines are convenient and easy to administer, which explains their widespread popularity. Tablets remove the need to visit the doctor's office for a shot or dose. Pharmacies can track the doses of medicine and keep track of refills. Patients may travel with the tablets and taking them when needed is very convenient.

Such large number of tablets can be problematic. The different colors, shapes, and sizes may confuse patients, especially elderly or handicapped ones. A large number of doses can give rise to safety concerns due to medication adherance. Further, some medicines are taken on an empty stomach, after a meal, or with water. The costs to manufacture and package such large number of tablets are costly and passed on to the patient by health care costs and increased insurance premiums. The need to carry a large number of doses may be aggravating, especially if taking them to work or school.

The large number of medicines taken on a regular basis also is harder on robotics to dispense pills or tablets because of the different shapes and sizes for the same medicine by different manufacturers. A lot of time and expense is needed to accommodate the different sizes with a variety of packages.

As noted above, tablets and pills include up to 90% inert ingredients that do not provide active medicine to the patient. Further, some patients may only need ½, ⅓, or ¼ of a pill for a dose. This requirement makes the patient cut the pills into parts, sometimes not very exact. Many tablets cannot be cut, especially gel tabs. Drugs are sometimes metabolized at different rates in people of varying ethnic backgrounds, resulting in inconsistent and unpredictable therapeutic effects. It is tough to understand these differences when taking doses from different sources.

As noted above, the current state of technology with regards to manufacturing, dispensing, and consumption is overly complex and inefficient. This result is unfavorable to the patient. Current manufacturing involves many steps and a multitude of inactive ingredients. The inactive ingredients may be classified as diluents, binders, disintegrants, lubricants, glidants, adsorbents, flavorants, and colorants. These inactive and inert ingredients are utilized to improve palatability and appearance. Some of these ingredients have unique properties that can impact bioavailability and stability. The compounds typically do not have any bearing on the efficacy of the active drug compound found in the pills and tablets.

The manufacturing process of conventional pill doses produces formulations that are of a fixed strength without allowing customization based on specific patient need. Due to the complexity of the manufacturing process, and the supply chain dynamics of both active and inactive ingredients, medication recalls, backorders, and shortages have become common in today's market. These problems lead to astronomical drug pricing but, more importantly, those patients with a critical need of these medications may be forced to go without them for extended periods of time. This puts unnecessary strain on the health care industry by raising costs, addressing needs only when critical (i.e., no preventative care), and putting patients at risk to further injury or complications.

With regard to allergies, it is now established that many of these inactive ingredients induce allergic reactions. Some patients who are found to be allergic to the inert ingredients are often forced to try different medications that may not be as effective. Additionally, due to the complexity of the manufacturing process for pills and tablets, it may be impossible to pinpoint the exact cause of any complications related to new medications taken by a patient.

As noted above, the manufacturing and production processes are costly due to the different shapes and sizes of tablets and pills. Costs are needlessly high. With so many variables in the supply chain, prices may fluctuate daily, sometimes to prohibitively high levels. Witness recent skyrocketing increases in medicine costs by hedge fund investors with no regard to making medicine available to those that need it. Moreover, due to the nature of the present pharmacy services model, additional costs are tacked on by pharmacies to provide quality control prior to dispensing. These costs are even more pronounced when tablets are provided in multi-dose compliance packages that are typically used to improve compliance. Wasted time occurs, as well, to ensure that dispensing is accurate. The cost for all of this is passed onto the patient.

Conventional systems of drug manufacturing and dispensing also are extremely error prone. Errors that can occur include, for example, the wrong drug mixed in the wrong pill, the wrong additives mixed or missed (thereby reducing bioavailability), the wrong pill, the wrong drug, and the wrong strength. Errors are not limited to these examples. Every step of the process provides significant room for human or robotic/system error.

All of the above shortcomings ultimately lead to poor outcomes for patients. Improper dosages or errors result in patients going to the hospital or urgent care, thereby driving up health care costs. Sometimes, improper doses may lead to permanent health problems or even death.

SUMMARY OF THE INVENTION

To address these issues, the disclosed embodiments allow members of the health care industry, such as doctors, pharmacists, and other healthcare providers, to securely modify the dosage regimen relying on novel technology and automated systems that provide tracking, security, accountability and efficiency. There is a need for custom capsules where multiple patient medicines can be consolidated into a reduced number of capsules. Preferably, all the active ingredients for a variety of medicines are placed into one capsule. The capsule can be built for the patient with more exact or customized dosing than available through conventional processes. Further, less inert ingredients are introduced into the body.

According to some embodiments, a computer-implemented method for packaging medicine dosages for a prescription is disclosed. The method includes determining a plurality of dosages for the prescription. Each dosage corresponds to an active ingredient of a medicine. The method also includes arranging a plurality of canisters according to the plurality of dosages. Each canister includes a straw having the active ingredient for the respective dosage. The method also includes moving a plurality of open capsules to a first canister of the plurality of canisters. The method also includes cutting a first dosage for a first active ingredient of a medicine from the straw held by the first canister. The method also includes packing the first dosage into an open capsule of the plurality of open capsules. The method also includes repeating the cutting and packing steps for each open capsule of the plurality of open capsules. The method also includes moving the plurality of open capsules to a second canister of the plurality of canisters. The method also includes cutting a second dosage for a second active ingredient of a medicine from the straw held by the second canister. The method also includes packing the second dosage into the open capsule of the plurality of open capsules. The method also includes repeating the cutting and packing steps for each open capsule of the plurality of open capsules. The method also includes sealing the plurality of open capsules.

According to some embodiments, a computer-operated system for providing customized medicine in a capsule is disclosed. The system includes a first canister having a straw of a first active ingredient for a medicine. The system also includes a second canister having a straw of a second active ingredient of a medicine. The system also includes a packing assembly for each of the first canister and the second canister to cut the straw according to a specified dosage for each active ingredient and place the dosage into a capsule. The system also includes a computer configured to determine the amount for each specified dosage for a plurality of dosages of a prescription and to arrange the first canister and the second canister accordingly. The system also includes a conveyor belt to move the capsule to the canisters and packing assemblies. The system also includes a capsule tray fitting device to seal the capsule.

According to some embodiments, a system to place a plurality of dosages of different medicines into a plurality of capsules is disclosed. The system includes a computer to determine how much of each dosage of the plurality of dosages to place into the plurality of capsules. The system also includes a plurality of canisters arranged by the computer to dispense the plurality of dosages. Each canister corresponds to an active ingredient for each dosage within a straw held by the respective canister. The system also includes a rotor arranged at each of the plurality of canisters to cut the respective straw according to the corresponding dosage of the active ingredient as determined by the computer. The system also includes a plunging apparatus arranged at the each of the plurality of canisters to place the corresponding dosage into each capsule of the plurality of capsules and to place a separator on top of the dosage. The system also includes a capsule tray fitting device to seal the plurality of capsules having the plurality of dosages.

BRIEF DESCRIPTION OF THE DRAWINGS

The accompanying drawings are included to provide further understanding of the invention and constitute a part of the specification. The drawings listed below illustrate embodiments of the invention and, together with the description, serve to explain the principles of the invention, as disclosed by the claims and their equivalents.

DETAILED DESCRIPTION OF THE PREFERRED EMBODIMENTS

Figure 1:
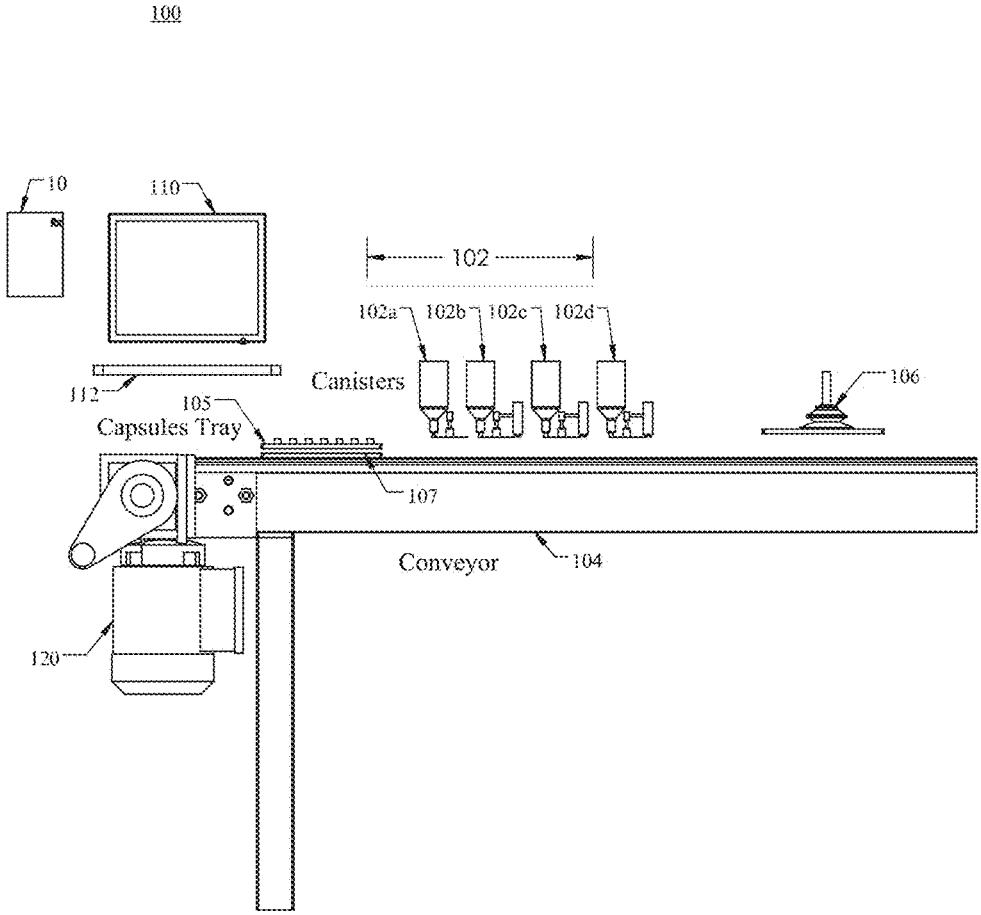
FIG. 1 illustrates a system for providing for customized medicine dosing according to the disclosed embodiments.

Aspects of the invention are disclosed in the accompanying description. Alternate embodiments of the present invention and their equivalents are devised without parting from the spirit or scope of the present invention. It should be noted that like elements disclosed below are indicated by like reference numbers in the drawings.

The disclosed embodiments provide a customized multiple-medication capsule. A plurality of drugs or medicine may be included in one capsule, along with the ability to provide exact, non-fixed dosing with little to no inert ingredients. As noted above, most conventional oral drugs are compressed into tablets or capsule that include the active ingredient and a large proportion of inert ingredients that provide no medicinal benefit to the patient.

To reduce the amount of unneeded ingredients entering a patient's body and the number of pills required daily, the disclosed systems add all active ingredients, or pure drug compounds, to a thin membrane casing material that differs for different drugs. The thin membrane casing material may resemble a straw in that active ingredients are stored in the material.

The drugs are stored in individual casings as needed for each one. For example, some membrane casing may be more porous than other, some may be water soluble, some may be made of resins, some may expand, contract, or dissolve as the casing enters the stomach. In some embodiments, the membrane casing may be comprised of thin plastic. The membrane casings also may have different diameters and lengths. The composition and size of the membrane casings themselves are determined by the type of drug molecules in the active ingredient that are held inside, and to ensure sufficient stability.

The membrane casings may be filled in a mechanical vial/container. Canisters are arranged in a row or a machine. A blank capsule is fed into the machine. The machine rolls the capsule along a conveyor belt, for example, to align with the drug canister that includes active ingredients to go into the capsule. The canister dispenses the membrane casing the proper, or proscribed, length to ensure the correct dosage of the active ingredient for the patient. A blade may cut the appropriate length of the membrane casing. The cut portion is dropped into the capsule for the patient. This dosage, or length of cut, may be customized at any time for the patient by updating the control software used by the system.

The capsule moves further down the conveyance means to the canister of ingredient. This process continues until all drugs, or active ingredients, for the capsule based on patient need are inserted. When completed, the entire dose for a patient for a particular time of dosage according to the disclosed process may be fit into one or two capsules, as opposed to a large number of pills having inert and filler ingredients.

Some embodiments also include adding a small radio frequency identification (RFID) chip to the capsule. The RFID chip allows one to monitor the movement of the capsule as it traverses the body of the patient. The chip also may allow the location of the capsule through GPS or other geolocation system. A small medication transceiver may be worn on the stomach of the patient to determine if the capsule entered the patient's stomach.

Thus, the disclosed embodiments simplify the manufacturing process. Drug manufacturers only need to provide pure drug compounds of active ingredients to the pharmacies and other medical facilities that implement the disclosed system and process. The conventional inert and filler ingredients need not be provided or stored. The exclusion of the inert and filler ingredients also decreases the likelihood of allergic reactions due to these ingredients.

Further, by simplifying the manufacturing process, costs to pharmaceutical services and products to patients may be reduced. The cost to dispense also is reduced with the implementation of improved and automated pharmacy quality control processes, available using the disclosed system and processes. Improved quality control and the ability to customize dosages also reduce costs for providing the medicine to the patient. Errors also removed by reducing the number of steps in the capsule manufacturing process and automation.

Another advantage is the improved adherence and compliance by reducing the complexity of the daily medication dosage regimen for patients. This may be especially applicable for elderly or special needs patients. Adherence and compliance as a barrier of efficacy will be overcome. Because the medication is stored conveniently in a capsule form, the patient is able to travel easily without the need for pill boxes or multiple bottles of doses.

The solutions presented by the disclosed embodiments address many variables in the drug manufacturing and dispensing process. They do away with many of the current practices and provide pharmacies the ability to customize medication delivery for patients. The current state of technology does not empower a pharmacy to provide a customized regimen based on a patient's needs. Further, variability and the reduction of inert and filler ingredients is not possible or encouraged.

Competition is enhanced and lower costs for drug delivery may be realized as the active ingredients for the drugs may come from any manufacturer. Generic makers of active ingredients may provide the stock for the capsules and reduce costs. Further, pharmacies may no longer need a lot of shelf space for pills, tablets, and the like as the amount of filler and inert ingredients is reduced. Moreover, pharmacies do not need to keep different dosages of the same drug, thereby reducing redundant stock of the same medicines.

FIG. 1 depicts a system 100 for providing for customized medicine dosing according to the disclosed embodiments. System 100 may be located in a pharmacy or other medical services facility. System 100 dispenses capsules having a prescribed amount of medicine for one or more patients. System 100 includes a conveyor belt 104, though other types of conveyance may be used.

System 100 also includes canisters 102. Each canister delivers an active ingredient, or medicine, according to the dosage needed. Canisters 102 may be broken into canister 102*a*, canister 102*b*, canister 102*c*, canister 102*d*, and canister 102*e*. These canisters hold different medicines for dispensing the prescription fulfillment process. Additional components are used in conjunction with the canisters to fill the capsules with medicine and disclosed in greater detail below.

Although FIG. 1 shows five canisters, any number may be used within system 100. For example, if the pharmacy routinely uses ten canisters to fill prescriptions, then system 100 includes ten canisters 102. Moreover, canisters 102 may be switched out depending on the need for several orders of prescriptions. For example, if the drug ingredient used in canister 102*d* is not needed for several hours, then this canister may be switched out.

Capsule tray 105 moves along conveyor belt 104 to locations underneath canisters 102. Capsule tray 105 initially holds empty capsules. An appropriate number of capsules may be held, such as 30 for a month's dosage. The tray may arrange the capsules in a row or series of rows. Capsule tray 105 may be comprised of plastic or metal. Attachment 107 attaches capsule tray 105 to conveyor belt 104. Attachment 107 may be any means of attachment to the conveyor belt, such as VELCRO™, an indentation in the belt approximately the shape of capsule tray 105, a plate, and the like. Attachment 107 moves capsule tray 105 along conveyor belt 104.

Capsule top cap fitting device 106 is located at the "end" of conveyor belt 104 to place the top caps on the capsules after they are filled with the drug ingredients. Device 106 also may seal the capsules.

System 100 also includes computer architecture to input information for prescriptions as well as customization of the dosages. Computing device 120 may receive instructions or signals from computer 110 that is provided to canisters 102 on dosages and other parameters needed to fulfill the prescription. Computing device 120 includes a processor, memory and a bus to communicate information throughout the device.

Prescription 10 may be received in a pharmacy and inputted into computer 110 using input device 112. Input device 112 may be a keyboard, display screen having a graphical user interface (GUI) and the like. Prescription 10 preferably has multiple medicines prescribed to the patient. The different medicines are entered into input device 112. Computer 110 may execute algorithms and analysis to determine any possible interaction problems between the active ingredients or with the patient's own biological information. Computer 110 then may instruct computing device 120 to adjust dosages accordingly.

In some embodiments, computer 110 and computing device 120 may be one computer. These components are shown separately to highlight the different functions of each. Both systems may execute software instructions to provide the functionality disclosed below using a processor and a memory to store the software instructions, as well as computer architecture to facilitate transmitting and receiving signals and information to the other components within system 100.

Figure 2:
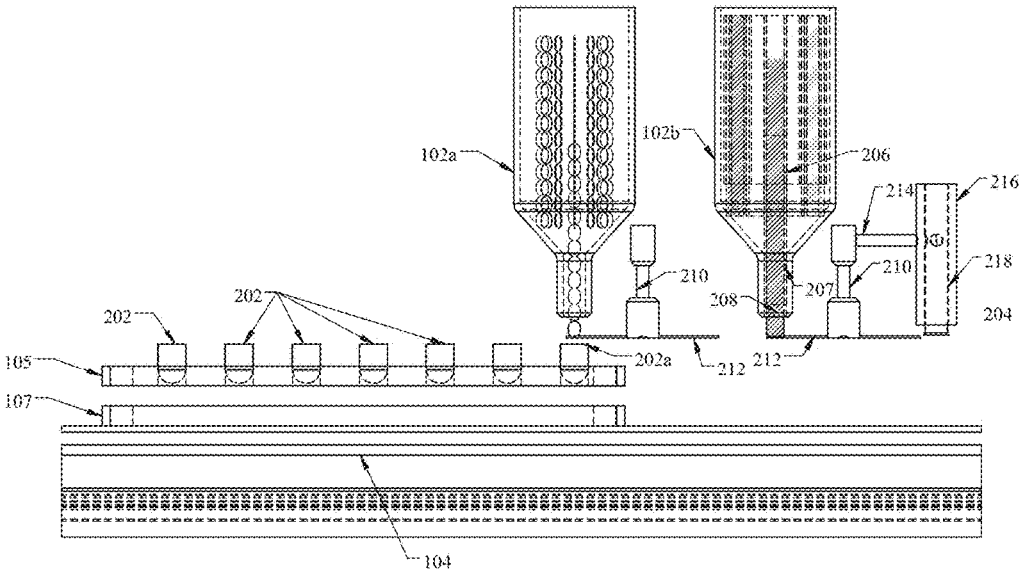
FIG. 2 illustrates a system for packaging medications according to the disclosed embodiments.

FIG. 2 depicts canister 102*a* and packing assembly 204 according to the disclosed embodiments. Capsules 202 are moved by conveyor belt 104 to be placed underneath canister 102*a*. Canister 102*a* then places medicine 208 into each capsule 202 using packing assembly 204. Packing assembly 204 includes several components that work together to place a specified amount of medicine 208 into the capsules.

As disclosed above, medicine 208 is the active ingredient for a prescription medicine. Preferably, medicine 208 does not include filler or inert ingredients. Packing assembly 204 places medicine 208 directly into each capsule 202. As shown, capsule 202*a* is being filled by canister 102*a*. Medicine 208 is held in drug filler straw 206. Straw 206 includes a membrane 207 to hold medicine 208, and to provide other features as disclosed below. Membrane 207 may extend out of straw 206 to deliver medicine 208.

Packing assembly 204 includes rotor 210 and blade 212. Rotor 210 moves blade 212 to cut portions of straw 206 having medicine 208 that is placed into capsule 202*a*. Rotor 210 also supports arm 214, which is connected to tube 216. Tube 216 encloses packer 218. Packing assembly 204 may receive instructions from computer 110 or computing device 120 to operate the various components in filling capsules 202.

System 100 includes similar configurations for canisters 102*b-e*. Capsules 202 move along conveyor belt 104 to receive different medicines 208.

Figure 3:
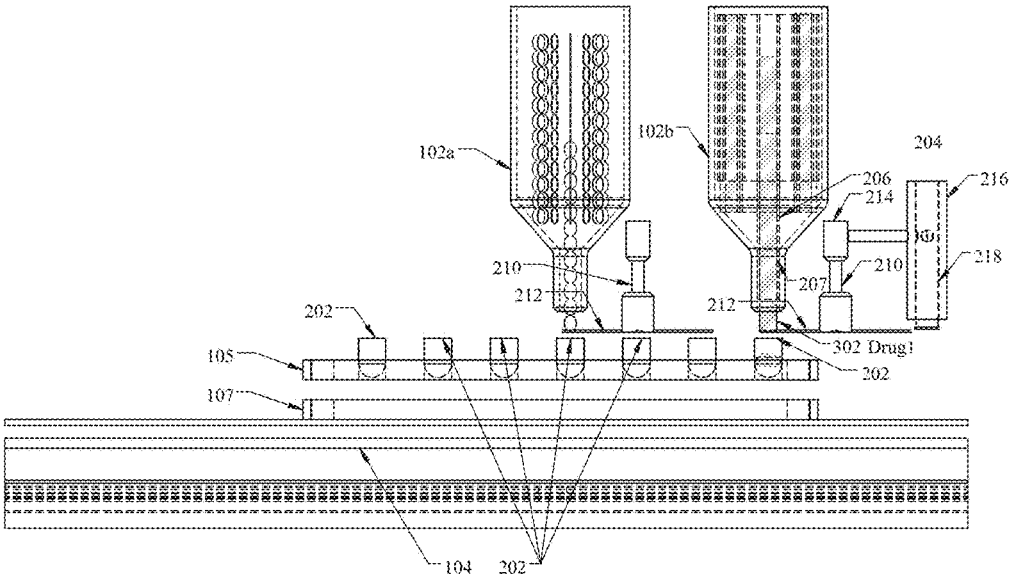
FIG. 3 illustrates medicine being placed into a capsule according to the disclosed embodiments.

FIG. 3 depicts medicine 208 being placed into capsule 202*a* according to the disclosed embodiments. Canister 102*a* extends straw 206 having medicine 208 down towards capsule 202*a*. Packing assembly 204 moves blade 212 using rotor 210 to engage straw 206. A precise portion 302 of the active drug is detached from straw 206 to be placed into capsule 202*a*.

Each capsule 202 within capsule tray 105 may be moved to receive a medicine portion 302. The amount of medicine portion 302 to be cut by blade 212 is determined and corresponds to the amount of active ingredient prescribed in prescription 10. As shown, blade 212 cuts through membrane 207.

Figure 4:
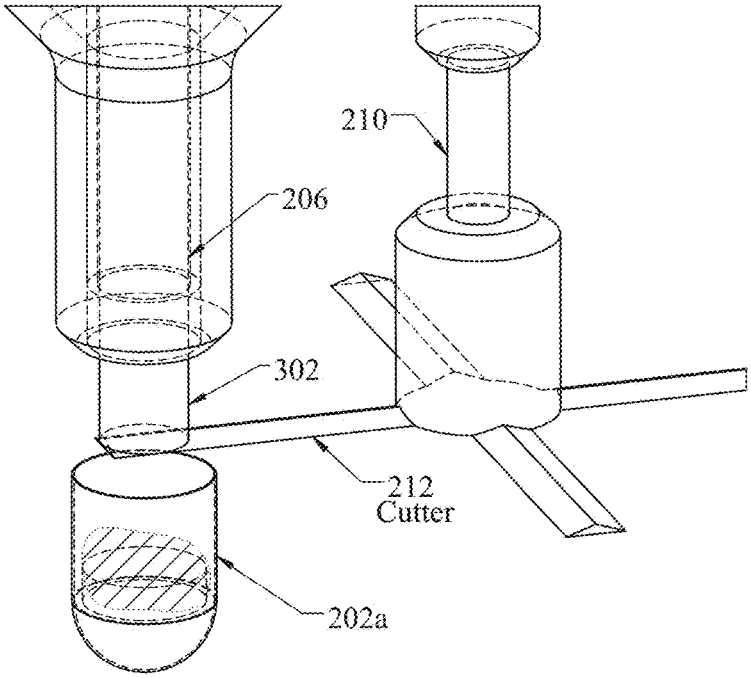
FIG. 4 illustrates an exploded view of a blade engaging a straw according to the disclosed embodiments.

FIG. 4 depicts an exploded view of blade 212 engaging straw 206 according to the disclosed embodiments. As shown, packing assembly 204 may include four blades 212, also known as blade cutters. The four blades may rotate using rotor 210 and as instructed by system 100. A blade 212 cuts into membrane 207 extending from straw 206 to detach medicine portion 302 for placement into capsule 202*a*.

Alternatively, packing assembly 204 may deploy two blades 212. As noted, an amount of medicine 208 is extended out of straw 206. One of blades 212 slices this amount held within membrane 207.

Figure 5:
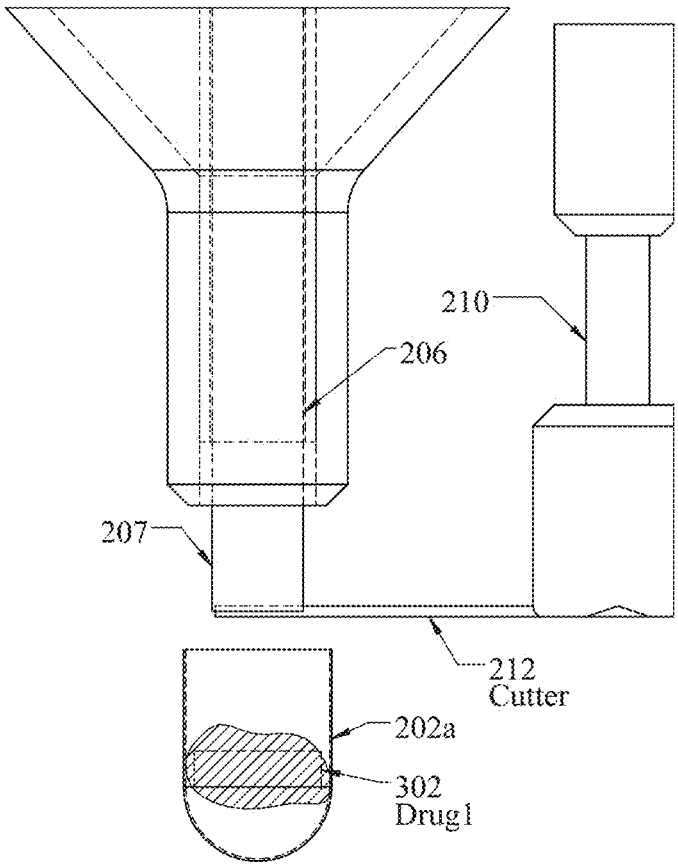
FIG. 5 illustrates the medicine portion inside the capsule according to the disclosed embodiments.

FIG. 5 depicts the medicine portion inside capsule 202*a* according to the disclosed embodiments. Here, medicine portion 302 enclosed by membrane 207 has been cut by blade 212. Rotor 210 keeps moving blade 212 past the point underneath straw 206 to position another arm of the blade for cutting. Membrane 207 extends from straw 206 to provide more medicine to remaining capsules 202.

Medicine portion 302 within capsule 202*a* corresponds to the amount of active ingredient of the drug listed in prescription 10. Packing assembly 204, therefore, may cut a consistent amount of the medicine for each capsule. Straw 206 extends membrane 207 and medicine 208 to same amount each time. Further, as shown in capsule 202*a*, medicine portion 302 is reduced in size from a whole capsule dedicated to delivering the active ingredient of the medicine. A conventional dosage using a capsule would include medicine portion 302 plus filler and inert ingredients.

Figure 6:
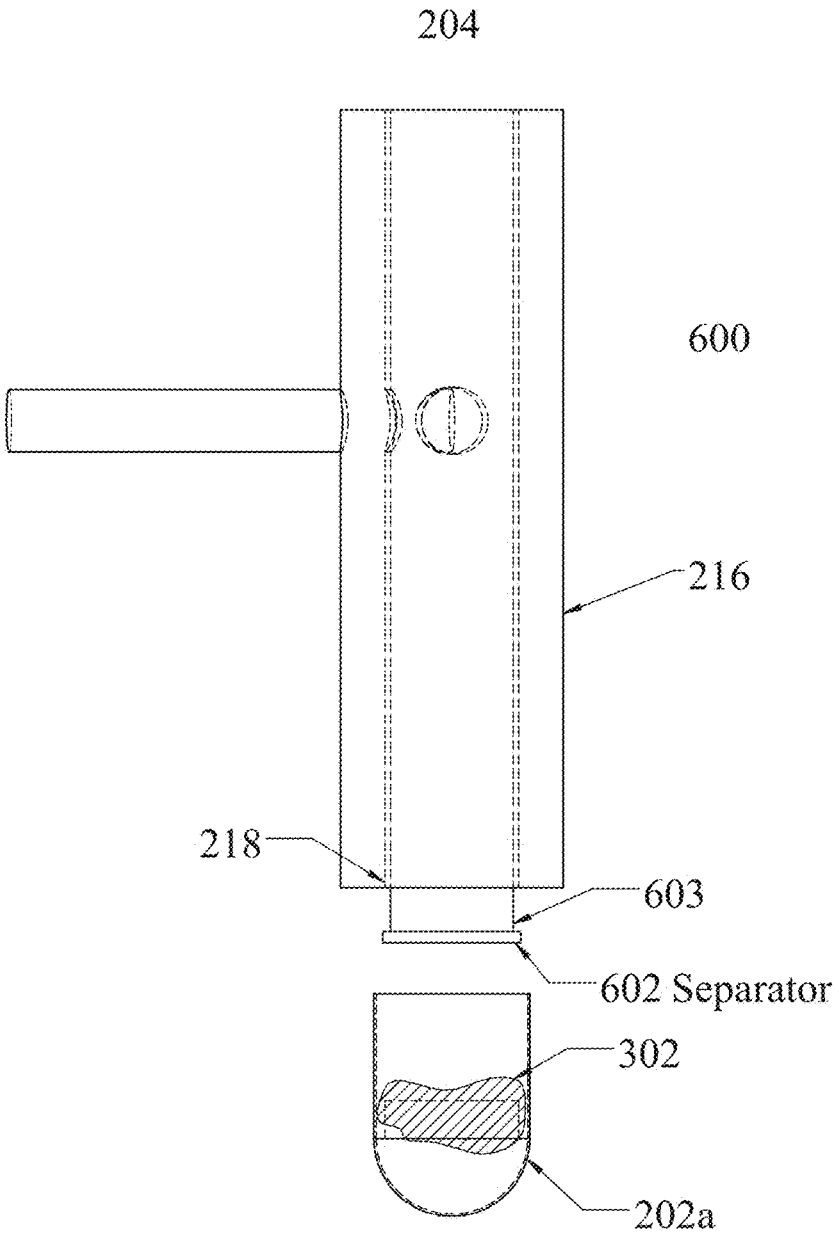
FIG. 6 illustrates a plunging apparatus of a packing assembly receiving the medicine portion according to the disclosed embodiments.
Figure 7:
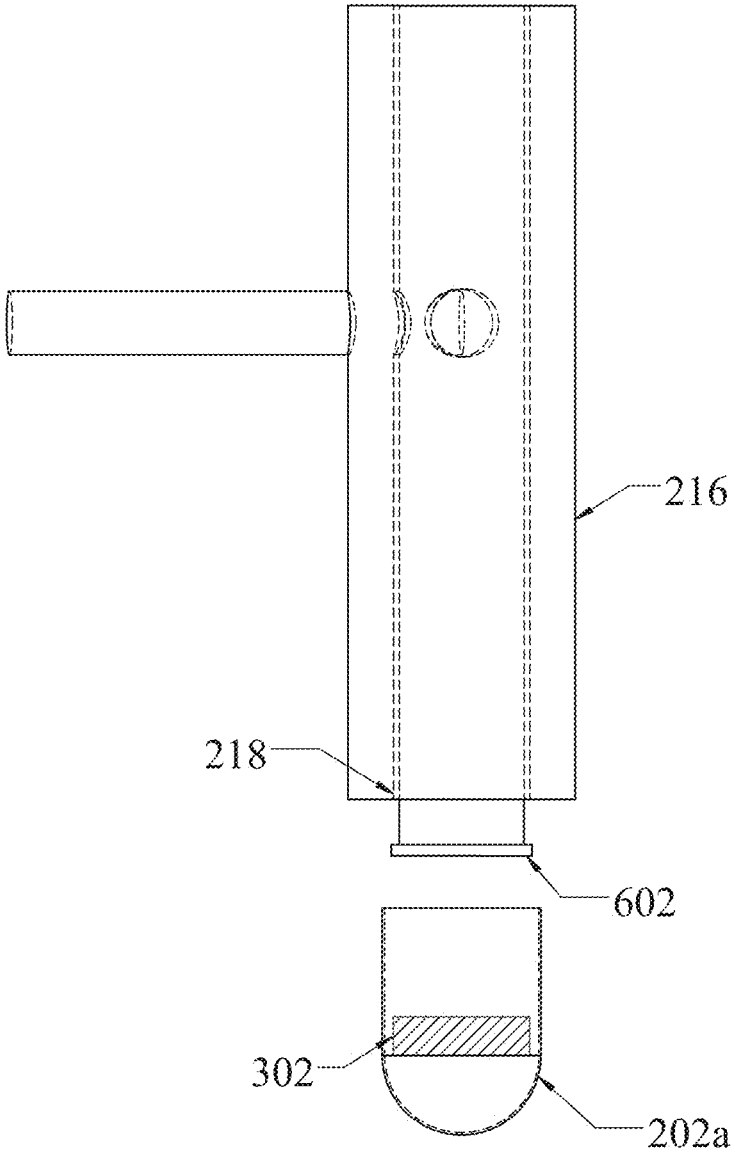
FIG. 7 illustrates the plunging apparatus packing the medicine portion into the capsule according to the disclosed embodiments.
Figure 8:
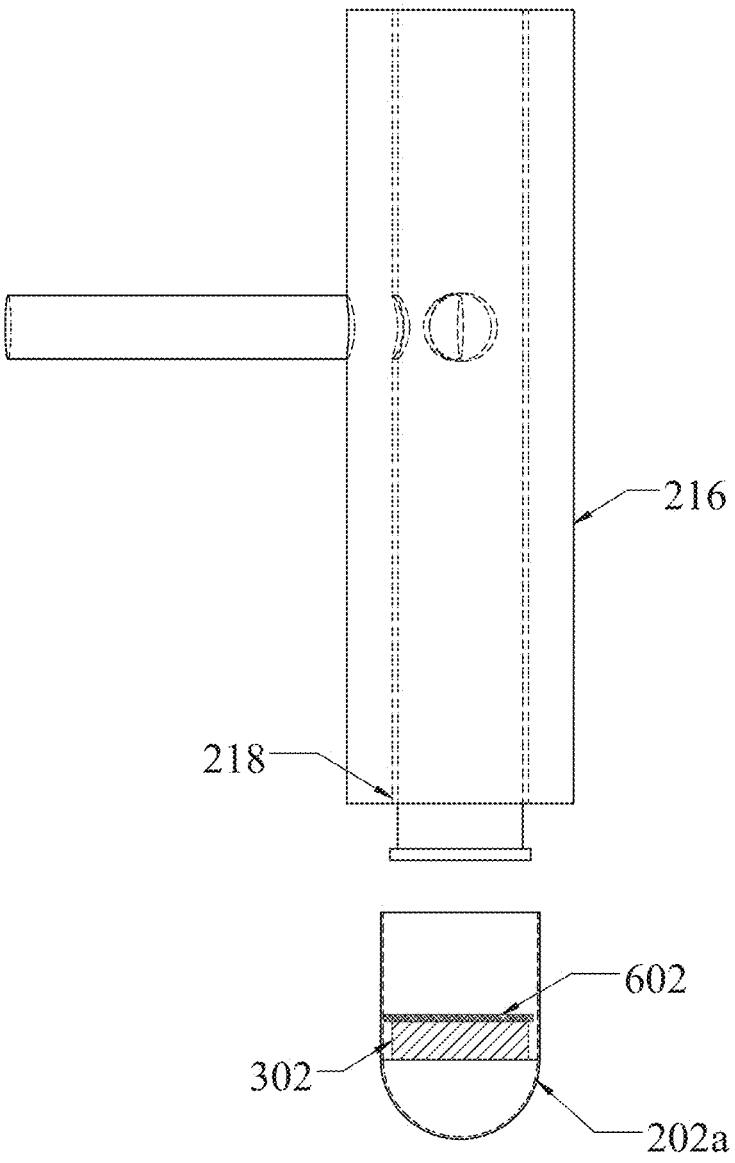
FIG. 8 illustrates the plunging apparatus and the packed capsule with the medicine portion according to the disclosed embodiments.

FIG. 6 depicts plunging apparatus 600 of packing assembly 204 receiving the medicine portion according to the disclosed embodiments. FIG. 7 depicts plunging apparatus 600 packing the medicine portion into the capsule according to the disclosed embodiments. FIG. 8 depicts the plunging apparatus and the packed capsule with the medicine portion according to the disclosed embodiments. Because FIGS. 6-8 are related, these figures are disclosed together.

Plunging apparatus 600 includes tube 216 and plunger 218 of packing assembly 204. Plunger 218 moves downward as controlled by tube 216. Initially, when capsule 202*a* is moved underneath tube 216, plunger 218 is in an upward location, extending only slightly out from the bottom portion to the tube. A separator 602 is placed on the bottom end of plunger 218. Separator 602 may be held by an adhesive portion 603.

Plunging apparatus 600 extends separator 602 into capsule 202*a* to cover medicine portion 302, thereby separating the active ingredients stored therein from other ingredients placed within capsule 202*a* by system 100. Thus, the active ingredients in medicine portion 302 do not mix with other medicines or drugs.

After placement of separator 602, plunger 218 moves upward back into tube 216. Separator 602 is now part of medicine portion 302. Capsule 202*a* is now finished with canister 102*a* and packing assembly 204. Another capsule 202 may be moved underneath 216 to receive a separator.

Plunger 218 may be used to determine the volume of each drug deposited into a capsule when it is pushed down. As noted above, 30 mg of drug M may not have the same volume as 30 mg of drug N. Plunger 218 and plunging apparatus 600 receives instructions from system 100 on how far to place the dosage into the capsule based on the volume of the amount of drug prescribed.

Figure 9:
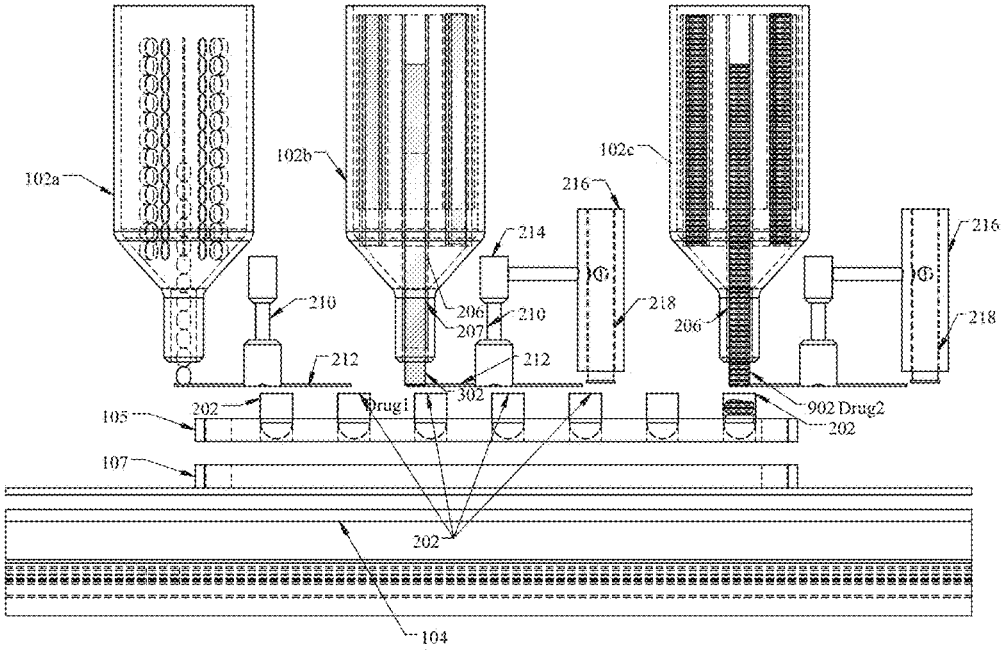
FIG. 9 illustrates the system moving the capsules to receive a second medicine portion using another canister according to the disclosed embodiments.

FIG. 9 depicts system 100 moving the capsules to receive a second medicine portion using another canister 102*b* according to the disclosed embodiments. Capsules 202 have been filled with medicine 208 and are now ready to receive the second dosage of a different active ingredient according to prescription 10. Conveyor belt 104 moves capsule tray 105 to canister 102*b*.

Canister 102*b* delivers medicine 902 to capsules 202. As shown, packing assembly 204 associated with canister 102*b* cuts a portion of membrane 207 extending from straw 206 out of the canister. This procedure executes as disclosed above with regards to canister 102*a*. A prescribed amount of medicine 902 is measured out in membrane 207 and then detached by blade 212.

Figure 10:
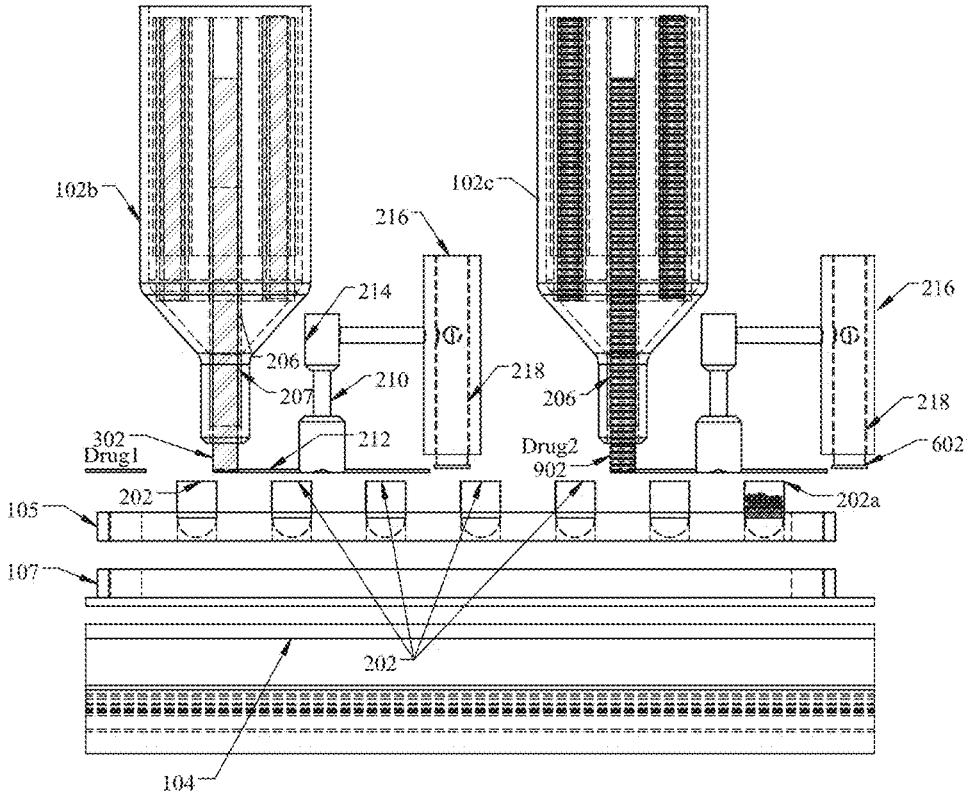
FIG. 10 illustrates a plunging apparatus for the next canister in the system according to the disclosed embodiments.
Figure 11:
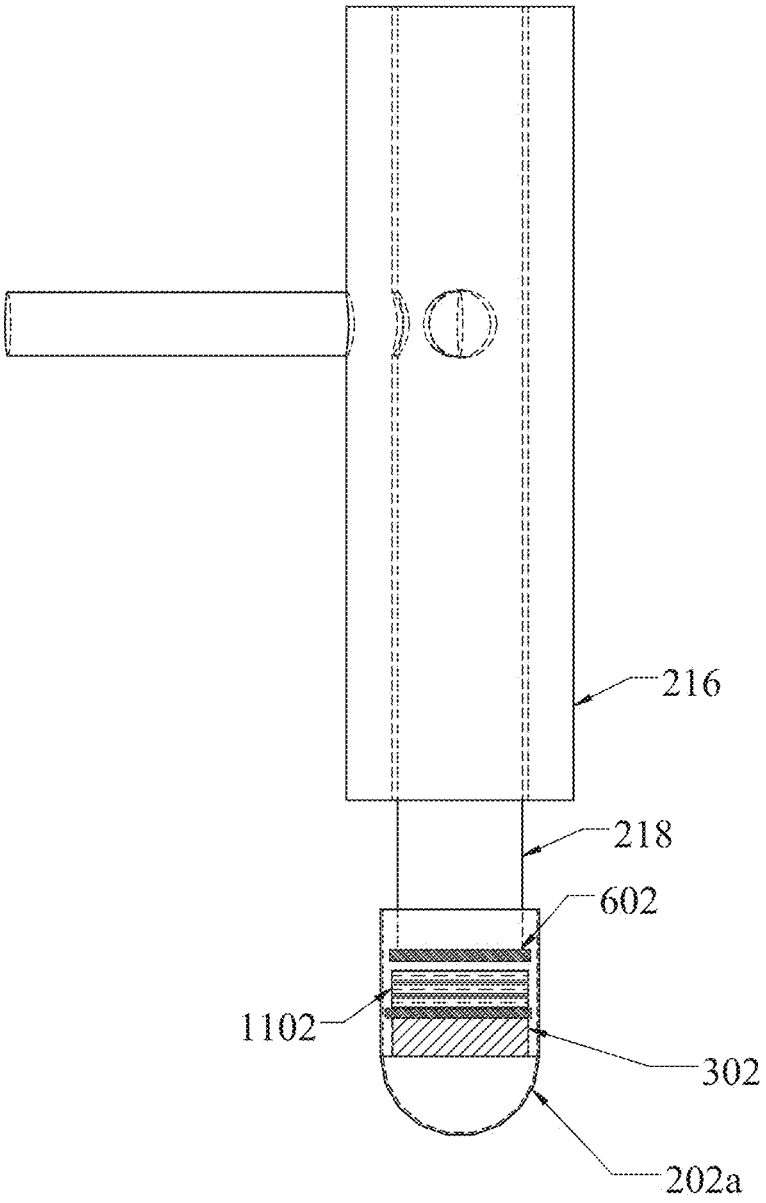
FIG. 11 depicts placement of the separator on the second medicine portion in the capsule according to the disclosed embodiments.

FIG. 10 depicts plunging apparatus 600 for canister 102*b* according to the disclosed embodiments. FIG. 11 depicts placement of the separator on the second medicine portion 902 in capsule 202*a* according to the disclosed embodiments. Capsule tray 105 is moved beneath plunging apparatus 600 that packs medicine 902 delivered by canister 102*b* into capsules 202. As shown, plunger 218 holds a second separator to be placed in capsule 202*a*. Tube 216 holds plunger 218.

Medicine portion 1102 is the amount of medicine 902 cut from straw 206 of canister 102*b*. Medicine portion 1102 is held by membrane 207 and relates the amount of active ingredient prescribed for the medicine by prescription 10. Medicine portion 1102 is not the same active ingredient as within medicine portion 302. Further, the medicine portions may not be the same amount, volume, weight and the like, though they could be the same.

As shown, medicine portion 1102 is placed on top of separator 602 for medicine portion 302. Plunger 218 then places a second separator 602 on top of medicine portion 1102 to keep its active ingredients from mixing with other ingredients within capsule 202*a*. Further, instead of requiring two capsules (or more) capsules to fulfill prescription 10, the disclosed embodiments may use only one capsule 202. Plunger 218 detaches second separator 602 and moves back upward to pack the next capsule in capsule tray 105.

Figure 12:
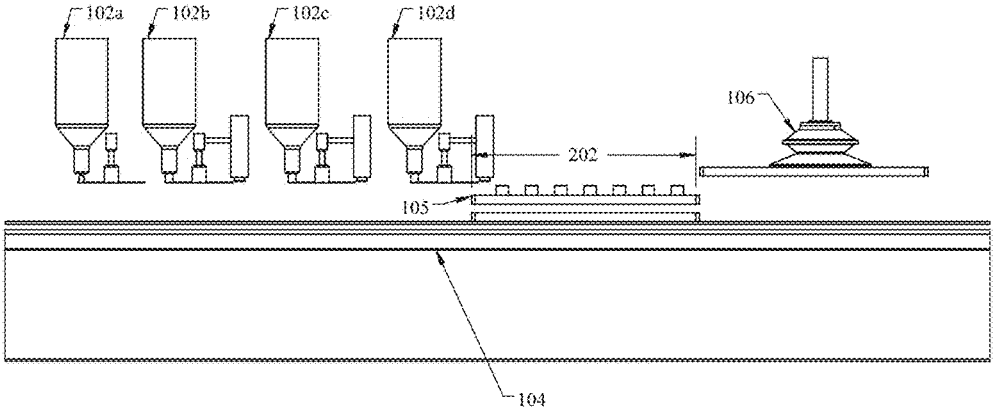
FIG. 12 illustrates the filled capsules within the system according to the disclosed embodiments.

This process may be repeated at the other canisters 102*c*, 102*d*, and 102*e* until capsules 202 are filled with medicine portions from each station. FIG. 12 depicts the filled capsules within system 100 according to the disclosed embodiments. Conveyor belt 104 moves capsule tray 105 beneath each canister. The associated packing assemblies 204 places separators 602 on top of each individual medicine portions cut from straws 206.

In some embodiments, a canister 102 and packing assembly 204 may place non-medicinal items into capsules 202, such as a RFID tag for tracking capsules. Essentially, because of the reduced need for room in each capsule, the disclosed embodiments may place additional items that are not able to fit in conventional capsules. A separator may be used to keep the active ingredients of the medicine portions from interacting with the additional items.

Figure 13:
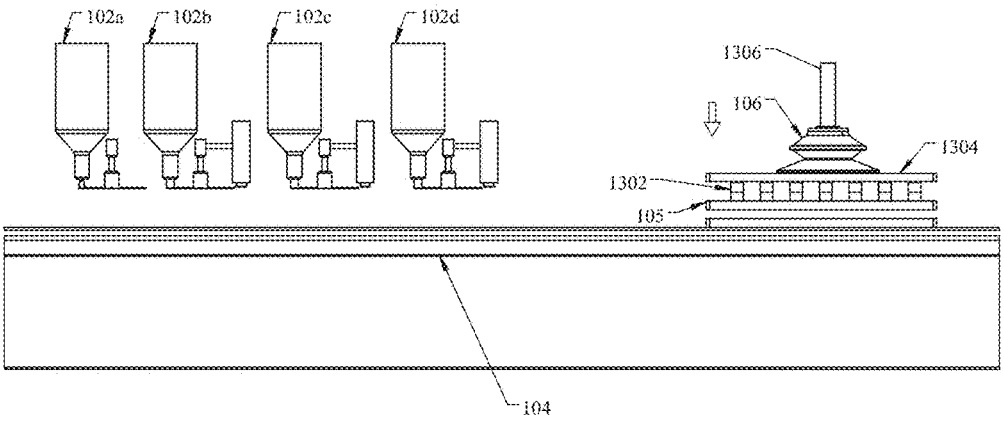
FIG. 13 depicts the capsule tray fitting device of the system according to the disclosed embodiments.

Conveyor belt 104 moves capsule tray 105 towards capsule tray fitting device 106. FIG. 13 depicts the capsule tray fitting device of system 100 according to the disclosed embodiments. Fitting device 106 places top cap fittings 1302 onto capsules 202 to seal them for delivery in response to prescription 10. Holder 1304 is moved into position above capsule tray 105 and pressed downward by bar 1306 to seal the capsules. Preferably, top cap fittings 1302 provide a snug seal so that heat or other means is not needed to properly keep ingredients from falling out the capsules.

At this stage, fitting device 106 also may perform other operations to identify and track capsules 202. RFID tags or other components may be fitted into the capsules. A finished capsule 1402 may be shown in FIG. 14. Finished capsule, or dosage, 1402 includes capsule 202 and top cap fitting 1302. It is sealed and may be taken by a patient as prescribed by prescription 10. Finished capsule 1402 also may include information about the dosages on capsule 202. Information may include text 1404 or other visual information that identifies some aspect of the medicines inside the capsule. Such information may include ingredients, patient name, and the like. The information also may include bar code marking 1406 for tracking and identifying the capsule.

Because each capsule is filled with ingredients that may differ between prescriptions, this information is important so that the proper dosage is provided to the right patient. Further, such information may be used for quality assurance measures.

Figure 15:
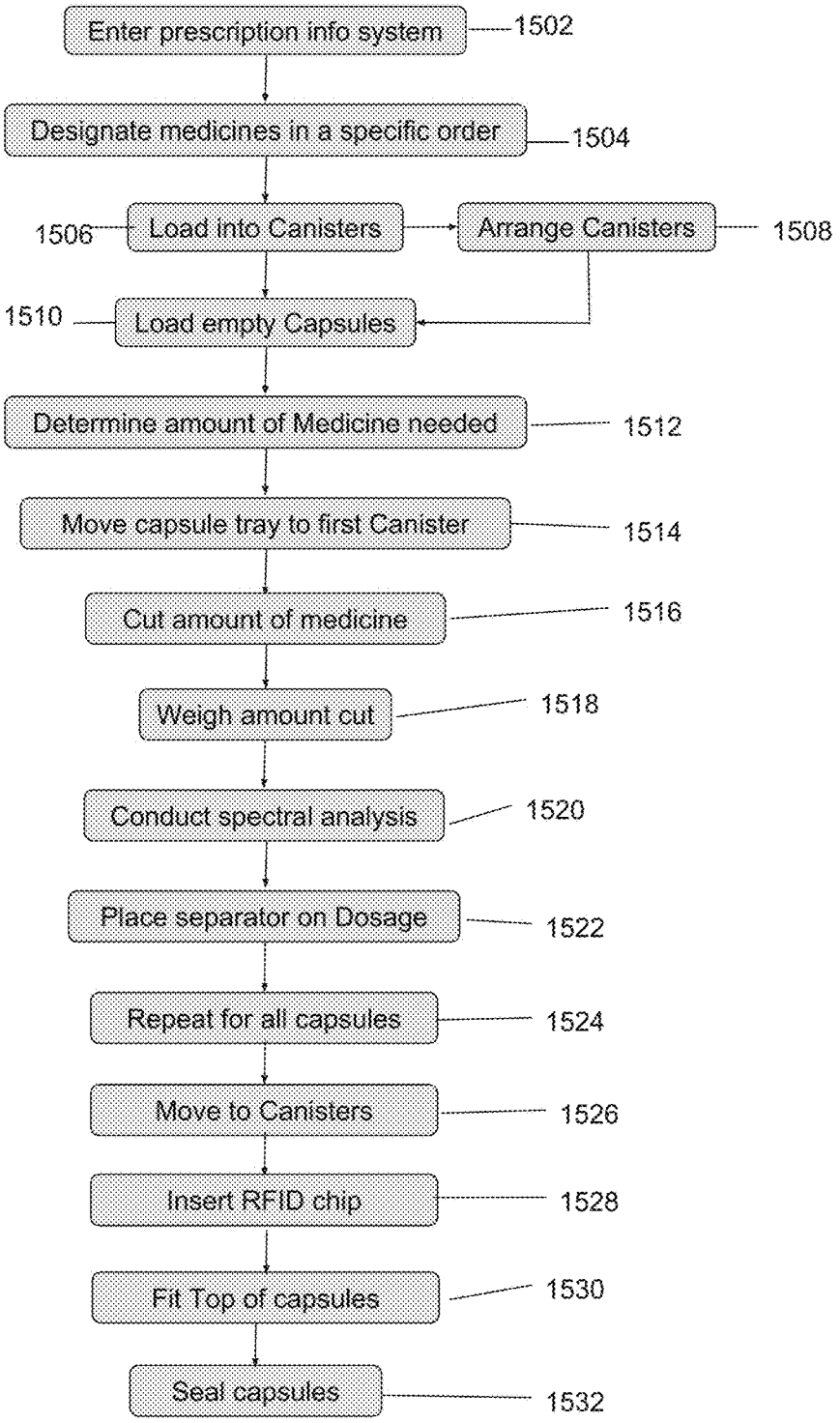
FIG. 15 illustrates a flow diagram for providing customized medicine dosages in a capsule according to the disclosed embodiments.

FIG. 15 illustrates a flow diagram 1500 for providing customized medicine dosages in a capsule according to the disclosed embodiments. Flow diagram 1500 includes functions that are performed by, for example, system 100 disclosed above. Computer 110 or computing device 120 may execute instructions to perform these functions by sending instructions to the different components within system 100. Where applicable, the disclosure of FIG. 15 will refer to components of system 100 for illustrative purposes.

A patient may be diagnosed with a myocardial infarction, or heart attack. Part of the regimen for the patient includes the prescribing of five (5) medications: two anti-platelet drugs, one ARM, one statin, and one beta-blocker. Examples of these drugs may include aspirin at 81 milligrams (mg) and clopidogrel at 75 mg for the anti-platelets, losartan at 50 mg for the ARB, atorvastatin at 80 mg for the statin, and bisoprolol at 5 mg for the beta-blocker.

A doctor may prescribe these five medications. The patient will take the prescription to the pharmacy of choice and, in the traditional setting, be given five bottles of five different pills. The patient also will be instructed on how to take each set of pills. If the patient has a difficult time remembering to take the medication, then the patient may opt to go to a pharmacy that provides compliance packaging services.

According to the disclosed embodiments, the patient would bring the prescription to a pharmacy practicing the disclosed system and processes. Fulfillment of the prescription may occur as disclosed below.

Figure 14:
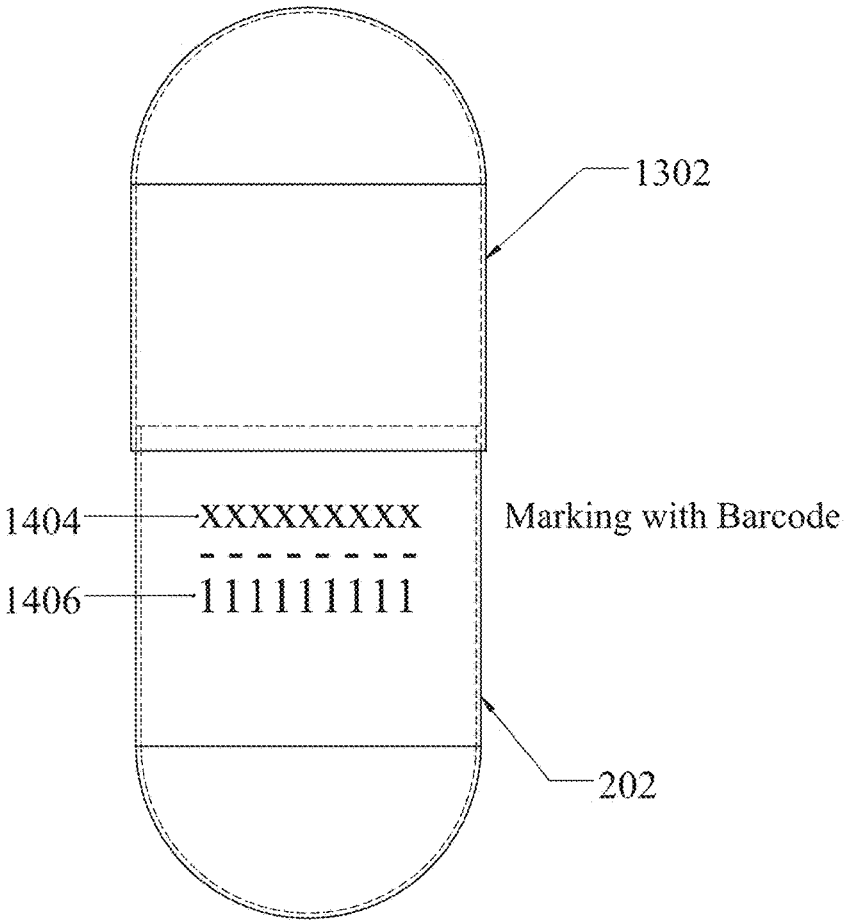
FIG. 14 illustrates a fitted capsule according to the disclosed embodiments.

Step 1502 executes by receiving prescription 10 at the pharmacy or medicine dispensing facility. The prescription may be for the active ingredients used in the example above. Step 1502 also executes by entering prescription 10 into system 100. The information entered is the dosages and types of drugs, as given above. Step 1504 executes by designating the medicines, or active ingredients listed in prescription 10, to a specific order. The medicines also may be designated to a specific capsule identification number, as shown in FIG. 14.

Step 1506 executes by loading the prescribed medicines into canisters 102. An automated robot within system 100 may have the pure form of the active ingredients pre-loaded into the canisters. If not, then the robot will load straws 206 into canisters 102. Straws 206 include medicines 208 related to the active ingredients of prescription 10.

Step 1508 also may execute by arranging canisters 102 in a specified order to deliver the medicines. In other words, system 100 may determine that the different active ingredients should be packed in a specified order. The robot may move canisters 102 to be in this order. Moreover, some active ingredients may react harmfully when placed in the same capsule as another active ingredient. System 100 may analyze the different ingredients and check them against known medical information to determine a proper order for placing the medicine in capsules 202, or remove the corresponding canister 102 from system 100.

Step 1510 executes by loading empty capsules 202 into capsule tray 105. For example, a month's supply, or 30 capsules, may be loaded. Capsules tray 105 is placed on conveyor belt 104 and moved along system 100.

Step 1512 executes by determining the amount of medicine needed for each dosage, based on prescription 10. System 100 receives the information, or determines it using computers 110 or 120, for the correct amount of drug to dispense and sends these instructions to canisters 102. Alternatively, other measures may be taken to determine how much medicine is placed into capsules 202. One alternative is that the outer casing may be any sort of compatible material useable with most drug compounds. The outer casing may be changed depending on the various compounds to ensure stability. Thus, system 100 may instruct canisters 102 to change casings (such as membranes 207) along with dosage instructions.

Another alternative determination may be dividing the pure active ingredient into fixed doses instead of how much material to be cut or separate from straws 206. Thus, packets of the active ingredients pre-measured may be loaded into canisters 102. The packets may include membranes 207. Another alternative is using capsules of different sizes depending on the overall regimen of medications.

Step 1514 executes by moving capsule tray 105 with the empty capsules to the first canister 102*a*. Canister 102*a* may include a straw 206 with aspirin. Thus, aspirin is the first active ingredient to be placed into the capsules. Conveyor belt 104 could carry multiple capsules at one time so that they may be filled at the same time to ensure efficiency and timeliness. Alternatively, conveyor belt 105 refers to any device, such as rollers with stops, that moves capsule tray 105 and allows the filling of multiple capsules or formulations at one time. Capsules 202 themselves may have different shapes and sizes, colors, and the like.

Step 1516 executes by cutting or dispensing the specified amount of medicine as prescribed and dropped into the appropriate capsule. Alternatively, a pre-selected packet of a size may be placed into the capsule. The cutting process is disclosed above. Conveyor belt 104 may be fitted with different molds, such as attachments 107, to hold capsule trays 105. Capsule trays 105 hold multiple capsules in one section and may rotate when aligned with canister 102*a*. System 100 efficiently cuts a plurality of doses of aspirin to drop into the capsules.

To ensure accuracy and safety, steps 1518 and 1520 may be executed. Step 1518 executes by weighing the amount cut or to be placed in the capsules. The length and weight of the medicine that is cut off is determined to ensure accuracy prior to placement in the capsule. Step 1520 executes by conducting a spectral analysis, such as spectrometry, to determine the composition of the medicine being cut or dispensed. The spectral analysis of the aspirin cut from straw 206 of canister 102*a* compares the received spectra to the known spectra for the medicine.

Step 1522 executes by placing a separator 602 into the capsule on top of the dosage of aspirin using plunging apparatus 600. Step 1524 executes by repeating steps 1516 to 1522 for all the capsules in capsule tray 105. As noted above, capsule tray 105 may be rotated by system 100 underneath canister 102*a*. Alternatively, canister 102*a* may be moved to different locations of the capsules to dispense the medicine.

Step 1526 executes by moving capsule tray 105 to the remaining canisters. For example, canister 102*b* may dispense atorvastatin in doses of 80 mg. Steps 1514 to 1524 may be repeated for each dosage of medicine prescribed in prescription 10. Step 1528 executes by inserting an RFID chip into each capsule, as disclosed above. Other nano devices may be placed into the capsules for compliance, safety, tracking, diagnosis, pharmacokinetics, and the like.

Step 1530 executes by moving capsule tray 105 to capsule tray fitting device 106 and fitting tops onto the capsules. Step 1532 executes by sealing the capsules shut with the different dosages of the active ingredients. The final capsule of the batch may be dispensed in a bottle or into compliance packaging for quality assurance of the batch. This capsule may be examined by a pharmacist or system 100 before the capsules of this batch are provided to the patient.

Figure 16:
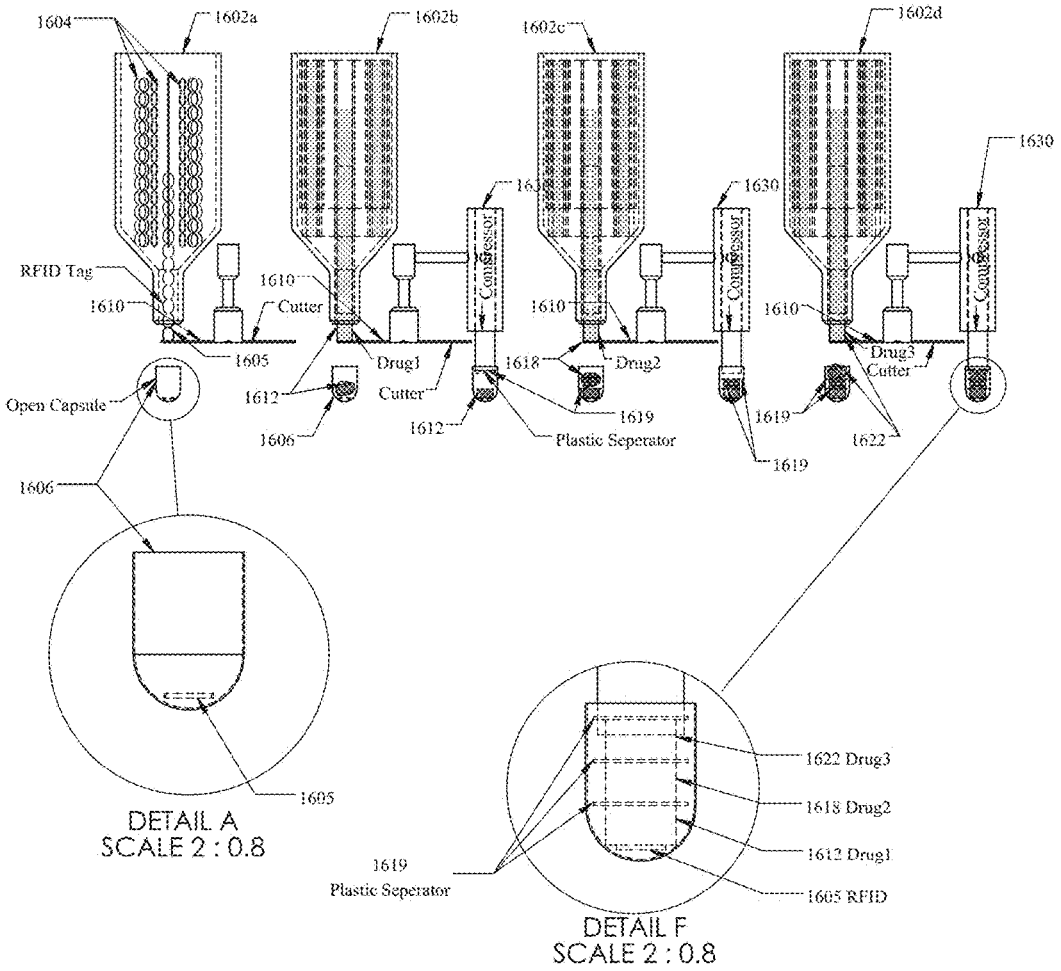
FIG. 16 illustrates another system for providing for customized medicine dosing according to the disclosed embodiments.

FIG. 16 illustrates another system 1600 for providing for customized medicine dosing according to the disclosed embodiments. System 1600 includes components and features disclosed in system 100 except with some differences, highlighted below. Conveyor belt 1650 moves the capsules beneath containers to receive specified dosages of various medicines as disclosed above.

System 1600, however, includes canisters 1602*a*, 1602*b*, 1602*c*, and 1602*d*. These canisters include straws to dispense the various drugs into open capsule 1606. Preferably, open capsule 1606 is located in a capsule tray, such as capsule tray 105. Unlike system 100, system 1600 places the RFID tags 1605 into open capsule 1606 prior to the dispensing of drugs. Thus, canister 1602*a* includes straws 1604 that hold RFID tags 1605. Alternatively, canister 1602*a* may use tubes instead of straws as RFID tags 1605 are not cut according to a specified dosage. Further, canister 1602*a* may drop the tags into open capsule 1606 with the need of a packaging assembly.

Canister 1602*b* includes straws 1608 which hold drug, or medicine, 1612. As shown, canister 1602*b* includes a plurality of straws 1608. As straws are used, replacement ones may be moved to dispense additional dosages of drug 1612. Rotor 1610 cuts the dosage from straw 1608 to place drug 1612 into open capsule 1606 along with RFID tag 1605. Plunging apparatus 1630 then places separator 1617 on top of the dosage of drug 1612. In this embodiment, plunging apparatus 1630 may be a distinct assembly from rotor 1610. Both components, however, may receive instructions from computer 110 or computing device 120.

Open capsule 1606 then moves underneath canister 1602*c* to receive a dosage of drug 1618. Straws 1614 hold the active ingredients for drug 1618. Like with canister 1602*b* and drug 1612, the measured dosage is extended outside canister 1602*c* and cut by rotor 1610. The dosage of drug 1618 is placed on top of separator 1617 placed prior to movement to canister 1602*c*. The respective plunging apparatus 1630 for canister 1602*c* places another separator 1617 on top of the dosage of drug 1618.

This process is repeated for canister 1602*d*, straws 1620 and drug 1622. Canister 1602*d*, however, may only include about 3 straws 1620. Perhaps drug 1622 is relatively expensive compared to other drugs and not administered frequently. It would not do the pharmacy much good to have large amounts of unused expensive drugs not being used. Alternatively, drug 1622 is quite common and just being used frequently in filling prescriptions. A sensor may be used in canister 1602*d* to alert personnel that it is down to 3 straws and may need to be refilled. Rotor 1610 cuts the specified dosage of drug 1622 from straw 1620 to be placed in open capsule 1606. Plunging apparatus 1630 places separator 1617 on top of the dosage to cover it.

Filled capsule 1632 is now ready to be sealed. Filled capsule includes RFID tag 1605, a dosage of drug 1612, a separator 1617, a dosage of drug 1618, a separator 1617, a dosage of drug 1622, and a separator 1617. Additional dosages of drugs may be placed into the capsule. As disclosed, filled capsule 1632 includes the active ingredients of the medicines prescribed and not fillers or inert ingredients just to occupy space in the capsule.

In other embodiments, an RFID tag is placed into each dosage. In other words, when an amount of drug is cut from the respective straw, an RFID tag is placed with the dosage along with the separator. In other embodiments, the RFID tag for each dosage may be placed into a separator, or each separator includes an RFID tag. The RFID tags may be used to determine compliance by ensuring the patient received the correct dosage of medicine in the capsules. In other words, a quick scan of the capsules before delivery to the patient checks to see if all prescribed drugs are included. Further, the RFID tags may be used to ensure the patient took the pills, which is beneficial feedback for healthcare providers as well as insurance companies.

The disclosed embodiments, using computer 110 or computing device 120, may execute a mathematical analysis before filling prescription 10 to determine how many active ingredients will fit into a capsule. The analysis may be done according to dosage and the volume of each active ingredient, as well as the volume of the capsule. For example, the prescription may call for 30 mg of the active ingredient in drug 1612 and 30 mg of the active ingredient in drug 1618. Even though the weight and the dosage are the same, the volume for each drug may be different. The disclosed embodiments may take this into account when doing its analysis of how to parse the ingredients for each capsule.

The disclosed embodiments, using system 100 or 1600, may provide non-standard dosages of drugs. For example, the prescription may call for 117 mg of acetaminophen. This dosage is not possible off the shelf. To receive such a dosage, the patient would have to cut up a 250 mg dosage, which is not efficient or hard to do. System 100 or 1600 would be able to provide such a dosage along with the other active ingredients prescribed to the patient.

The following example may illustrate the disclosed embodiments. A prescription is received with the following instructions, with the term "dosage" indicating a different active ingredient or different dosage sizes of the same active ingredients:

| Morning | Afternoon | Evening |
|---|---|---|
| Dosage A | Dosage B | Dosage A |
| Dosage C | Dosage D | Dosage D |
| Dosage F- before breakfast | Dosage G | Dosage E |
| Dosage G | | Dosage G |

The patient is instructed to take 11 dosages a day. This number of pills can be unwieldy and confusing. On a weekly trip, the patient would have to pack 77 doses of pills! Using the disclosed systems and processes, the number of capsules is reduced to 4 per day. One capsule includes dosages A, C, and G for the morning. A second capsule includes dosages B, D, and G for the afternoon. A third capsule includes dosages A, D, E, and G for the evening. The fourth capsule includes dosage F as it must be taken before breakfast on an empty stomach, while the first capsule is taken with breakfast.

In some embodiments, an analysis may be done to determine whether the active ingredients are compatible with each other. For example, prescription 10 includes medicine A that is taken with food and medicine B that is taken on an empty stomach. These medicines should not be placed into capsules with each other as they should not be taken at the same time. Thus, the canister with medicine B will be held out from the batch of capsules including doses of medicine A. Medicine B may be placed into another batch of capsules.

System 100, therefore, may not include all doses in one batch, but analyzes prescription 10 to determine how many batches of capsules will be created. Other factors may be related to patient through medical conditions, doctor recommendations, known conflicts between medicines, DNA analysis, and the like. The active ingredients in the prescription may be run through a database of incompatible drugs.

Drug-drug interactions occur when a drug interacts, or interferes, with another drug. This can alter the way one or both of the drugs act in the body, or cause unexpected side effects. The drugs involved can be prescription medications, over-the-counter medicines and even vitamins and herbal products. The disclosed embodiments take this into account when determining which dosages to fill in which capsules.

For example, not all drug-drug interactions are equal. Sometimes when two drugs interact, the overall effect of one or both of the drugs may be greater than desired. For example, both aspirin and blood-thinners like warfarin and Coumadin, used to protect against heart attack, help to prevent blood clots from forming. Using these medications together, however, may cause excessive bleeding. Other times, the overall effect of one or both of the drugs may be less than desired. For example, certain antacids can prevent many medicines (such as antibiotics, blood-thinners and heart medications) from being absorbed into the blood stream. If this happens, the medicine may not work as well, or may not work at all. Thus, the disclosed embodiments must take into account such interactions when determining and specifying the dosages. Computer 110 may access a dynamic database that stores interaction information and does an analysis on a received prescription to determine the best way to fill the capsules.

Using another example, the active ingredient of digoxin and verapamil or amiodarone may cause a severe interaction which can raise or lower the digoxin levels, which is a very potent drug, by 60-75%. It may be hard to adjust the dose because current manufacturing methods create digoxin tablets that are extremely small. Thus, the disclosed embodiments would need to run the analysis through computer 110 against the database to ensure that these two drugs are not included in the same capsule. Amiodarone may decrease the clearance of digoxin, resulting in prolonged digoxin activity. There may also be an additive effect on the sinus node of the heart. The disclosed embodiments would identify this and flag this fact when determining how many capsules and what ingredients go into each.

The disclosed embodiments also may take into ethnicity and background, as different drugs impact people differently depending on the genetic makeup of the patient. The disclosed embodiments may have a patient fill out a questionnaire that includes pertinent questions involving the patient's background to add to the database. Once stored in the database, this information may be cross-referenced with well known medical databases to ensure harmful interactions are avoided in filling the capsules.

For example, the disclosed embodiments may perform a process that does computations based on drug to drug interactions. In the example, drugs A, B, and C are prescribed for the patient. Drugs A, B, and C are tested to determine efficacy of each drug on the other drugs that also are included in the capsule. Based on the computations and comparisons, the dosages for the drugs may be adjusted. Additional steps using the same tests are performed for ethnicity and other factors, including a DNA analysis. The disclosed process may act like a feedback loop that runs through the process again and again to get a final result for recommended dosages.

In another example, the patient is prescribed drug G for an illness. The patient profile (DNA, ethnicity, past history, allergies, and the like) suggests that this patient should take no more that 200 mg of element X per day. The disclosed embodiments analyzes and determines that drug G holds 125 mg of element X, which is perhaps not the main ingredient but included as part of the overall drug. The disclosed embodiments then perform an analysis on all prescribed drugs being taken by the patient. Drugs H, I, and J, for example, are the drugs prescribed in addition to drug G. The analysis determines that the aggregate total of element X would be 250 mg. Obviously, this amount violates the patient profile limitations. The disclosed embodiments may do an adjustment to minimize the levels of element X while still providing drugs G, H, I, and J. The amount of element X cut from the respective straw may be limited to 200 mg.

It will be apparent to those skilled in the art that various modifications and variations may be made in the disclosed embodiments of the disclosed methods and systems without departing from the spirit or scope of the invention. Thus, it is intended that the present invention covers the modifications and variations of the embodiments disclosed above provided that the modifications and variations come within the scope of any claims and their equivalents.

What is claimed is:

1. A computer-implemented method for packaging medicine dosages for a prescription, the method comprising:

determining a plurality of dosages for the prescription, wherein each dosage corresponds to an active ingredient of a medicine;

arranging a plurality of canisters according to the plurality of dosages, wherein each canister includes a straw having the active ingredient for the respective dosage;

moving a plurality of open capsules to a first canister of the plurality of canisters;

cutting a first dosage for a first active ingredient of a medicine from the straw held by the first canister;

packing the first dosage into an open capsule of the plurality of open capsules;

repeating the cutting and packing steps for each open capsule of the plurality of open capsules;

moving the plurality of open capsules to a second canister of the plurality of canisters;

cutting a second dosage for a second active ingredient of a medicine from the straw held by the second canister;

packing the second dosage into the open capsule of the plurality of open capsules;

repeating the cutting and packing steps for each open capsule of the plurality of open capsules; and sealing the plurality of open capsules.

2. The method of claim 1, further comprising moving the plurality of open capsules in a capsule tray on a conveyor belt.

3. The method of claim 1, further comprising inserting a radio frequency identification chip into the plurality of open capsules.

4. The method of claim 3, wherein the inserting step occurs prior to the step of moving the plurality of open capsules to the first canister.

5. The method of claim 1, wherein the dosages correspond to active ingredients of different medicines.

6. The method of claim 1, further comprising placing a separator between each dosage of the plurality of dosages.

7. The method of claim 1, further comprising weighing each dosage of the plurality of dosages to confirm that the dosage is correct.

8. The method of claim 1, wherein the cutting steps include cutting the straw with a blade.

9. The method of claim 1, wherein the determining step includes determining another set of open capsules for a subset of the plurality of dosages.

* * * * *